US005683194A

United States Patent [19]

Emmel et al.

[11] Patent Number: 5,683,194

[45] Date of Patent: Nov. 4, 1997

[54] ATTACHING STRIPS FOR DOCUMENTS

[75] Inventors: John J. Emmel, Anoka; Alden R. Miles, Lakeville; Kim K. Tsujimoto, Coon Rapids, all of Minn.

[73] Assignee: Minnesota Mining and Manufacturing Company, St. Paul, Minn.

[21] Appl. No.: 568,272

[22] Filed: Dec. 6, 1995

Related U.S. Application Data

[60] Provisional application No. 60/000,418 June 22, 1995

[51] Int. Cl.[6] ..... B42F 13/00

[52] U.S. Cl. ..... 402/79; 281/38; 402/500

[58] Field of Search ..... 283/36; 402/79, 402/500; 281/38, 21.1, 46

[56] References Cited

U.S. PATENT DOCUMENTS

| | | | |
|---|---|---|---|
| 3,691,140 | 9/1972 | Silver | 260/78.5 |
| 4,127,690 | 11/1978 | Schleifenbaum et al. | 428/40 |
| 4,166,152 | 8/1979 | Baker et al. | 428/522 |
| 4,662,770 | 5/1987 | Block | 402/80 R |
| 4,715,759 | 12/1987 | Larque | 412/33 |
| 4,800,170 | 1/1989 | Jain et al. | 437/24 |
| 4,961,666 | 10/1990 | Pitts et al. | 402/79 |
| 4,990,018 | 2/1991 | Best et al. | 402/79 |
| 5,016,370 | 5/1991 | Rhian et al. | 283/36 |
| 5,248,164 | 9/1993 | Lepretre | 281/22 |

FOREIGN PATENT DOCUMENTS

| | | |
|---|---|---|
| 0 266 454 | 5/1988 | European Pat. Off. . |
| 2 543 066 | 3/1983 | France . |
| U 76 34 812 | 4/1977 | Germany . |
| A 43 24 353 | 3/1994 | Germany . |
| WO 87/02941 | 5/1987 | WIPO . |

*Primary Examiner*—Willmon Fridie, Jr.

*Attorney, Agent, or Firm*—Gary L. Griswold; Walter N. Kirn; William L. Huebsch

[57] ABSTRACT

A strip for attaching a document to a binder without punching openings in the document or for reinforcing a document around openings formed in the document through which the document can be mounted in a binder. The strip comprises an elongate layer of thin flexible material, and a coating of repositionable pressure sensitive adhesive on one major surface along an inner edge portion. That layer is free of adhesive on both of its side surfaces along an outer edge portion. That outer edge portion is visually distinctive, and the juncture between the inner and outer portions is straight and visibly distinctive. The strip has at least one opening through its outer edge portion adapted to receive a portion of a binders so that a document to which the coating of adhesive along its inner edge portion is adhered with the edge of the document along the juncture between the inner and outer portions can be bound in the binder without punching the document, or, alternatively, so that a punched document having a through opening by which the document is bound in a binder can be reinforced by adhering the coating of adhesive to the document with the opening in the outer edge portion in alignment with the opening in the document.

13 Claims, 1 Drawing Sheet

ATTACHING STRIPS FOR DOCUMENTS

CROSS-REFERENCE TO RELATED APPLICATION

This application claims priority to U.S. Provisional patent application Ser. No. 60/000,418, filed Jun. 22, 1995.

1. Technical Field

The present invention relates generally to strips that can be adhered to documents and have openings adapted to receive the fasteners in binders so that documents can be mounted in the binders without punching them.

2. Background Art

Documents are often kept in binders such as 3-ring binders, personal organizers, etc. Documents can be altered to fit into those binders by punching holes along edge portions of the documents. A hole-punching device may not always be readily available, however. Also, punching holes in a document causes permanently damage to it and can remove information from the document. Punched documents are susceptible to tears around the holes. Damaged areas of documents around such holes can be reinforced by using reinforcing rings, but this is time-consuming and can cover information on the document.

Strips are known that can be adhered to documents and have openings adapted to receive the fasteners in binders so that documents can be mounted in the binders without punching them. U.S. Pat. No. 4,800,170 describes such a strip for which the "glue needs to be heated to secure page binder with spine section with a number of closely adjacent beads of hot melt glue". Other such strips are adhered by layers of pressure sensitive adhesive covered by liners that must be removed before the strips are used. For example, U.S. Pat. No. 5,248,164 describes a "binder with a stub edge, notable, for filing loose-leaf and intermediate sheets". This "binder" has "one or two vertical strips coated with a non-permanent adhesive layer protected by a protective film". EP 0 266 454 B1 describes "a binder for connecting two sheet formed articles of paper or the like . . . [the] end portions being provided with an adhesive layer covered by sheet of release paper and application onto the respective article forming a strong adhesive bond therewith." Liner-free strips for attaching loose documents into a file folder or ting-binder are described in WO87/02941 (Cheng), in FR2 543 066, and in U.S. Pat. No. 4,715,759 which describes "a system of counterfoil binding, fit in particular to classify documents in the form of loose sheets" and states that the strip "can be either transparent or opaque."

DISCLOSURE OF THE INVENTION

The present invention provides a strip that can be used either for attaching a document to a binder without punching openings in the document or, alternatively, for reinforcing a document around openings formed in the document through which the document can be mounted in a binder.

The strip according to the present invention comprises (1) an elongate layer of thin flexible material having opposite major side surfaces, opposite ends, inner and outer opposite elongate edges between its ends, an inner edge portion along its inner edge, and an outer edge portion along its outer edge; and (2) a coating of repositionable pressure sensitive adhesive on one major surface along the inner edge portion, with the layer being free of adhesive on both of its side surfaces along its outer edge portion. The outer edge portion of the strip is visually distinctive, and the juncture between the inner and outer portions is visibly distinctive. The strip has at least one and typically a plurality of spaced openings through the outer edge portion of the layer that are adapted to receive portions of binders. Thus, a document to which the coating of adhesive along the inner edge portion is adhered with the edge of the document along the juncture between the inner and outer portions can be bound in a binder without punching the document by attaching the outer portion to the binder. Alternatively, a punched document having openings through which the document is bound in a binder can be reinforced by adhering the coating of adhesive on the inner edge portion to the document with the openings in the outer edge portion of the strip in alignment with the openings in the document.

The openings can be in of many shapes (e.g., holes, slots, or slits) and can be shaped and spaced to match any required configuration (e.g., for a standard 3 ring binder, for personal organizers, for file folders, for wound wire binders, for prong fasteners, for report covers, or the like).

Preferably the edge portions of the layer are adapted to be written on by using most standard writing implements so that a person can record information on the removable strip without defacing the document mounted by the strip; and so that, if desired, the strip can be custom printed, for example, by using flexographic printing.

Also, preferably the outer edge portion is smaller in area than the inner edge portion and is brightly colored (e.g., by a colored ink). Such coloring can be used, for example to color code the type of document being bound in a binder, and the juncture between the inner and outer portions is useful to align the edge of a sheet to be bound with the strip being attached to it.

The strips can be perforated, either along their lengths or across their widths, to afford, for example, separation of the inner and outer edge portions if only one portion is needed for a particular purpose; or to shorten the strip, or to afford removal of a short portion of the strip that can be used in the manner of a tape flag to mark some portion of a document.

A plurality of the strips can be releasably adhered to each other by the coatings of pressure sensitive adhesive to form a stack from which individual strips can be easily removed by manually engaging the outer edge portions that are not adhered together.

BRIEF DESCRIPTION OF THE DRAWING

The present invention will be further described with reference to the accompanying drawing wherein like reference numerals refer to like parts in the several views, and wherein.

DETAILED DESCRIPTION OF THE PREFERRED EMBODIMENT

Figure 1:
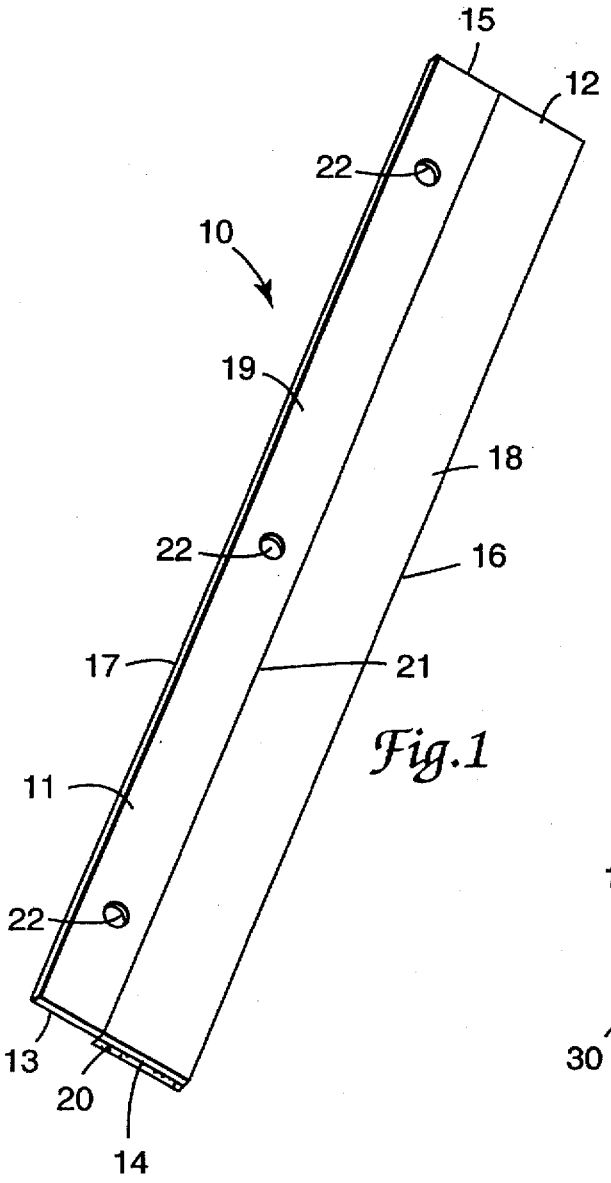
FIG. 1 is a perspective view of a first embodiment of a strip according to the present invention.

Referring now to FIG. 1 of the drawing, there is illustrated a strip 10 according to the present invention, which strip 10 can be used for attaching a document to a binder without punching openings in the document or, alternatively, for reinforcing a document around openings formed in the document through which the document can be mounted in a binder.

The strip 10 comprises an elongate layer 11 of thin flexible material (e.g., polymeric film such as cellulose acetate, polypropylene, or the preferred 0.0056 centimeter or 0.0022 inch thick polyester, although such material from 0.0038 to 0.0076 centimeter thick is also usable), having opposite major side surfaces 12 and 13, opposite ends 14 and 15, inner and outer opposite elongate edges 16 and 17, an inner edge portion 18 along its inner edge 16, and an outer edge portion 19 along its outer edge 17. The strip 10 includes a coating 20 of repositionable pressure sensitive adhesive (e.g., the pressure sensitive adhesive described in U.S. Pat. Nos. 3,691,140 and 4,166,152 incorporated herein by reference) on its one major surface 13 along the inner edge portion 18 of the layer 11, with the layer 11 being free of adhesive on both of the side surfaces 12 and 13 along the outer edge portion 19 of the layer 11. The outer edge portion 19 is visually distinctive (e.g., coated with brightly colored ink such as red, green, or yellow ink); and the juncture 21 between the inner and outer edge portions 18 and 19 is straight and visibly distinctive. The strip 10 has at least one, and as illustrated, a plurality of spaced openings 22 through its outer edge portion 19 adapted to receive portions of binders so that a document (not illustrated) to which the coating 20 of adhesive along its inner edge portion 18 is adhered with the edge of the document along the juncture 21 between the inner and outer portions 18 and 19 can be bound in a binder without punching the document. Alternatively, a punched document having openings through which the document is bound in a binder can be reinforced by adhering the coating 20 of adhesive to the document with the openings 22 in the outer edge portion 19 in alignment with the openings in the document.

Figure 2:
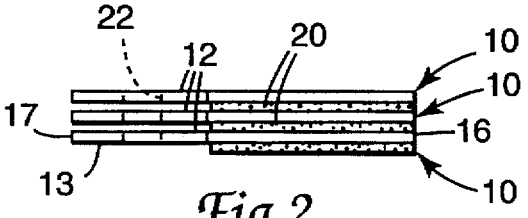
FIG. 2 is an enlarged end view of a stack of the strips of FIG. 1.
Figure 4:
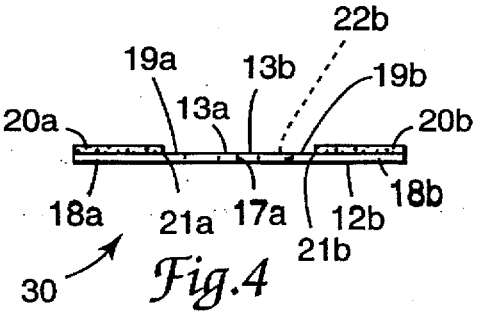
FIG. 4 is an end view of the strip of FIG. 3.

The adhesive coated inner edge portion 18 can be generally transparent when adhered to a substrate if the layer 11 is of polymeric film; and the major surface 13 of the layer 11 can be coated with a layer of release coating that can be written or printed on and/or a layer of low adhesion backsize (not shown) that, as is illustrated in FIG. 2, allows a plurality of the strips 10 to be adhered together in a stack without the need for a liner between the strips 10. A single liner or back sheet (not shown) may be used to protect the coating 20 of adhesive on the bottom strip 10 in the stack.

The strip 10 can be made in any length, and can be made slightly shorter in length than the document to which it is intended to be attached, which saves material and affords easy alignment of the strip 10 along the edge of the document, is because the ends of the strip 10 and the document do not have to be precisely aligned.

The inner and outer edge portions 18 and 19 can be of any desired width, with the preferred width for the outer edge portion 19 being between about 0.50 to 0.75 inch wide, and the preferred width for the inner edge portion 18 being between about 0.75 to 1.25 inches wide.

Figure 3:
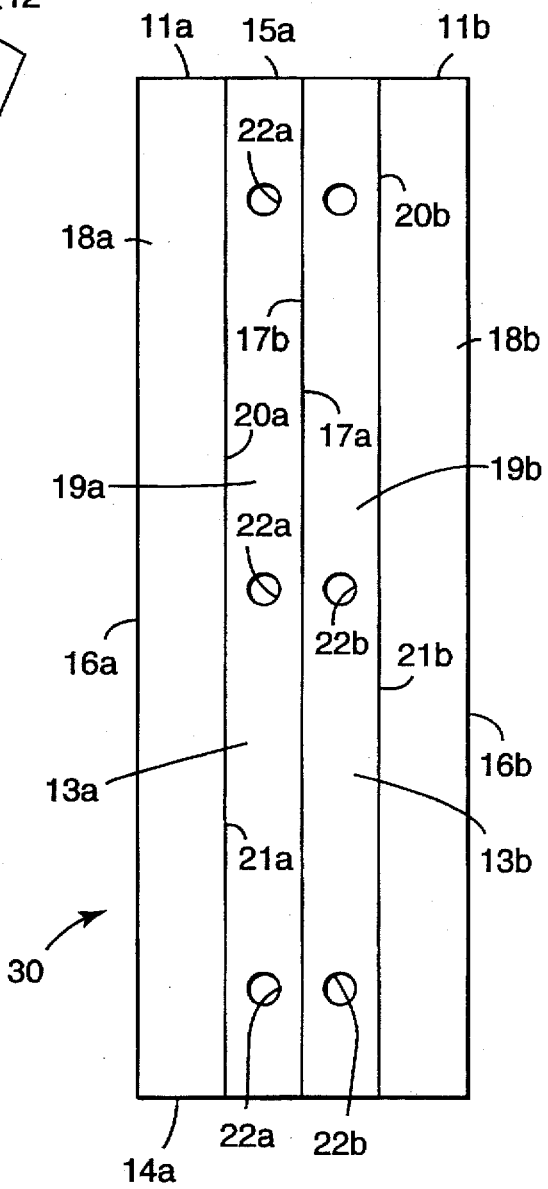
FIGS. 3 is a bottom view of a second embodiment of a strip according to the present invention.

FIG. 3 illustrates a strip 30 according to the present invention which is essentially two of the strips 10 illustrated in FIG. 1, the parts of the strip 30 being identified with the same reference numerals used on corresponding portions of the strip 10 to which have been added the suffixes "a" and "b" respectively. The two layers **11*a* and 11*b* in the strip 30 are joined along their outer edges 17*a* and 17*b* by having those layers 11*a* and 11*b* formed integral with each other (alternatively, the layers 11*a* and 11*b* could be separate and a heat fused or adhesively applied hinge layer could join them). The first and second layers of material 11*a* and 11*b* are pivotable relative to each other about their outer edges 17*a* and 17*b* between a position with those first and second layers of material 11*a* and 11*b* generally coplanar, to a position illustrated with those first and second layers of material 11*a* and 11*b* and the layers of adhesive 20*a* and 20*b* on them in opposition to each other so they can be adhered to opposite surfaces of a document or a stack of bound or attached documents. Such attachment can be with the edge of the document or edges of the outer documents along the junctures 21*a* and 21*b* between the inner and outer portions 18*a* and 19*a* or 18*b* and 19*b* so that the document or documents can be bound in the binder without being punched, or with the strips 10*a* and 10*b*** adhered to opposite surfaces of a punched document having a through opening by which the document is bound in a binder with the openings in the outer edge portions in alignment with the opening in the document to reinforce that document.

As illustrated, the layers **20*a* and 20*b* of repositionable adhesive would opposite each other when the strip 30 is attached, however those layers could be offset from each other. Also, the strips 30 could be adhered together in a stack in the manner of the strips 10**.

The present invention has now been described with reference to several embodiments thereof. It will be apparent to those skilled in the art that many changes can be made in the embodiments described without departing from the scope of the present invention. For example, for some applications the layer of flexible material could be of synthetic paper, reinforced paper, card stock, or non-woven, etc., instead of polymeric film. Either of the strips 10 or 30 could be part of a concatenation of strips wound in a roll and either separable at a desired length on a cutting device similar to a tape dispenser, or transversely perforated between adjacent strips to afford manual separation. Thus, the scope of the present invention should not be limited to the structures and methods described in this application, but only by the structures and method described by the language of the claims and the equivalents thereof.

We claim:

1. A strip for attaching a document to a binder without punching openings in the document or for reinforcing a document around openings formed in the document through which the document can be mounted in a binder, said strip comprising:

an elongate layer of thin flexible material having opposite major side surfaces, opposite ends, inner and outer opposite elongate edges, an inner edge portion along said inner edge, and an outer edge portion along said outer edge;

a coating of repositionable pressure sensitive adhesive on one major surface along said inner edge portion, with said layer being free of adhesive on both of said side surfaces along said outer edge portion, said outer edge portion being visually distinctive, and the juncture between said inner and outer portions being straight and visibly distinctive;

said strip having at least one opening through said outer edge portion adapted to receive a portion of a binders so that a document to which the coating of adhesive along said inner edge portion is adhered with the edge of the document along the juncture between the inner and outer portions can be bound in the binder without punching the document, and so that a punched document having a through opening by which the document is bound in a binder can be reinforced by adhering the coating of adhesive to the document with the opening in the outer edge portion in alignment with the opening in the document.

2. A strip according to claim 1 wherein said layer is of polymeric film, said edge portions are adapted to be written on, and said adhesive coated inner edge portion is generally transparent when adhered to a substrate.

3. A strip according to claim 1 wherein said outer edge portion is smaller in area than said inner edge portion and is brightly colored.

4. A strip according to claim 1 formed from only a single layer of polymeric material with said outer edge portion printed with a brightly colored ink to provide said visual distinction.

5. A strip according to claim 1 wherein said layer is of polymeric material having a thickness in the range of 0.0038 to 0.0076 centimeter.

6. A strip according to claim 1 wherein said layer is of about 0.0056 centimeter thick polyester.

7. A strip according to claim 1 wherein said elongate layer of material is a first layer of material and said strip further comprising a second elongate layer of flexible material having opposite major side surfaces, opposite ends, inner and outer opposite elongate edges, an inner edge portion along said inner edge, and an outer edge portion along said outer edge; a coating of repositionable pressure sensitive adhesive on one major surface along said inner edge portion, with said second elongate layer of material being free of adhesive on both of said side surfaces along said outer edge portion, said outer edge portion being visually distinctive, and the juncture between said inner and outer portions being straight and visibly distinctive; said strip having at least one opening through said outer edge portion of said second layer of material adapted to receive a portion of a binder; the outer edge of said second layer of material being attached along the outer edge of the first layer of material and the first and second layers of material being pivotable relative to each other about said outer edges between a position with said first and second layer of material generally coplanar, to a position with said layers of adhesive in opposition to each other so they can be adhered to opposite surfaces of a document with the edge of the document along the juncture between the inner and outer portions and that document can be bound in the binder without punching the document, and so that they can be adhered to opposite surfaces of a punched document having a through opening by which the document is bound in a binder with the opening in the outer edge portion in alignment with the opening in the document to reinforce that document.

8. A plurality of strips for attaching documents to a binder without punching openings in the documents or for reinforcing document around openings formed in the document through which the document can be mounted in a binder, each of said strips comprising:

an elongate layer of flexible polymeric material having opposite major side surfaces, opposite ends, inner and outer opposite elongate edges, an inner edge portion along said inner edge, and an outer edge portion along said outer edge;

a coating of repositionable pressure sensitive adhesive on one major surface along said inner edge portion, with said layer being free of adhesive on both of said side surfaces along said outer edge portion, said outer edge portion being visually distinctive, and the juncture between said inner and outer portions being straight and visibly distinctive;

said strip having a plurality of spaced openings through said outer edge portion adapted to receive portions of binders so that a document to which the coating of adhesive along said inner edge portion is adhered with the edge of the document along the juncture between the inner and outer portions can be bound in a binder without punching the document, and so that a punched document having through openings by which the document is bound in a binder can be reinforced by adhering the coating of adhesive to the document with the openings in the outer edge portion in alignment with the openings in the document, said strips being releasably adhered to each other by said coatings of pressure sensitive adhesive to form a stack with adjacent ends of said sheets aligned.

9. A plurality of strips in a stack according to claim 8 wherein said edge portions of said strips are adapted to be written on, and said adhesive coated inner edge portion is generally transparent when adhered to a substrate,.

10. A plurality of strips according to claim 8 wherein said outer edge portions are smaller in area than said inner edge portions and are brightly colored.

11. A plurality of strips according to claim 8 wherein each of said strips is formed from only a single layer of polymeric material with said outer edge portion printed with a brightly colored ink to provide said visual distinction.

12. A plurality of strips according to claim 8 wherein said layers of polymeric material have thicknesses in the range of 0.0038 to 0.0076 centimeter.

13. A plurality of strips according to claim 8 wherein said layers of polymeric material are about 0.0056 centimeter thick polyester.

* * * * *